US007597074B2

(12) United States Patent
Fuwa

(10) Patent No.: US 7,597,074 B2
(45) Date of Patent: Oct. 6, 2009

(54) CONTROL SYSTEM AND METHOD FOR CONTROLLING AN INTERNAL COMBUSTION ENGINE

(75) Inventor: Naohide Fuwa, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 372 days.

(21) Appl. No.: 11/640,851

(22) Filed: Dec. 19, 2006

(65) Prior Publication Data

US 2007/0157896 A1 Jul. 12, 2007

(30) Foreign Application Priority Data

Jan. 12, 2006 (JP) ..... 2006-005138

(51) Int. Cl.
*F01L 1/34* (2006.01)

(52) U.S. Cl. ..... 123/90.16; 123/346

(58) Field of Classification Search ..... 123/90.15, 123/90.16, 90.17, 90.18, 345, 346, 347, 348
See application file for complete search history.

(56) References Cited

U.S. PATENT DOCUMENTS 6,877,466 B2 * 4/2005 Shindou et al. ..... 123/90.16
2004/0261738 A1 12/2004 Machida et al.

FOREIGN PATENT DOCUMENTS

| | | |
|---|---|---|
| JP | A 2001-182567 | 7/2001 |
| JP | A 2001-263015 | 9/2001 |
| JP | A 2003-041977 | 2/2003 |
| JP | A 2004-340013 | 12/2004 |
| JP | A 2005-016339 | 1/2005 |
| JP | A 2005-307935 | 11/2005 |
| JP | A 2007-182864 | 7/2007 |

* cited by examiner

*Primary Examiner*—Ching Chang
(74) *Attorney, Agent, or Firm*—Oliff & Berridge, PLC

(57) ABSTRACT

An engine includes two or more banks, VVTL mechanisms provided for the respective banks for changing the operating characteristics of intake valves, and a control device that controls the VVTL mechanisms. The control device controls the VVTL mechanisms by integrating a plurality of pieces of control information corresponding to the respective VVTL mechanisms. When one of the pieces of control information becomes unknown, the control device performs a process of learning the control information with respect to the VVTL mechanism for the bank involving the unknown control information, and continues to control the VVTL mechanism for the other bank or banks, using the corresponding control information.

6 Claims, 11 Drawing Sheets

CONTROL SYSTEM AND METHOD FOR CONTROLLING AN INTERNAL COMBUSTION ENGINE

INCORPORATION BY REFERENCE

The disclosure of Japanese Patent Application No. 2006-005138, filed on Jan. 12, 2006, including the specification, drawings and abstract, is incorporated herein by reference in its entirety.

BACKGROUND OF THE INVENTION

1. Field of the Invention

The invention relates to a control system and method for controlling an internal combustion engine, and more particularly to an engine control system and method for controlling a plurality of variable valve actuating mechanisms provided for a plurality of banks of the engine to change the operating characteristics of intake or exhaust valves.

2. Description of Related Art

A control system, which is related to the invention, for an internal combustion engine equipped with a variable valve actuating mechanism is described in, for example, Japanese Patent Application Publication No. 2003-41977. The variable valve actuating mechanism has an actuator that changes the duration of each intake valve, which corresponds to the period during which the intake valve is open. The control system described in the above-identified publication learns the position of the maximum-lift end of the actuator (which provides the longest duration of the intake valve) and the minimum-lift end (which provides the shortest duration), so as to control the variable valve actuating mechanism with high accuracy.

When conditions that allow the operation of the variable valve actuating mechanism are satisfied for the first time after an ignition switch is turned on, for example, the control system as described above learns the position of the maximum-lift end of the actuator corresponding to the longest duration and the position of the minimum-lift end corresponding to the shortest duration. The control system then operates the engine while varying the duration with reference to the thus learned positions.

Occasionally, the learned values of the positions of the maximum-lift end and the minimum-lift end may be cleared or eliminated due to, for example, electrical noise. In this case, the operating position (absolute position) of the variable valve actuating mechanism cannot be detected until the reference positions are learned again. In the case of a V-type engine having two banks, for example, a learned value or values associated with the variable valve actuating mechanism for only one of the two banks may be eliminated. However, the issue of how to re-learn the reference positions without affecting the operation of the running vehicle or engine remains.

SUMMARY OF THE INVENTION

The invention provides a control system and method for controlling an internal combustion engine that reduce the influence of a loss of the learned value or values associated with a variable valve actuating mechanism on the operation of the vehicle or engine.

A first aspect of the invention provides a control system for an internal combustion engine including a plurality of banks, a plurality of variable valve actuating mechanisms, provided for the respective banks, for changing operating characteristics of variable valves (e.g. intake valves or exhaust valves), and a control device that controls the variable valve actuating mechanisms. The control device controls the variable valve actuating mechanisms by integrating a plurality of pieces of control information corresponding to the respective variable valve actuating mechanisms, and, in the event that one of the plurality of pieces of control information becomes unknown, the control device learns the control information with respect to the variable valve actuating mechanism for the bank involving the unknown control information, and continues to control the variable valve actuating mechanism for the other bank or banks, using the corresponding control information of the other respective variable valve actuating mechanisms.

Furthermore, each of the variable valve actuating mechanisms may include an actuator that moves a drive element to determine the lift of each of the intake valves of the corresponding bank, and a sensor that detects a change in a relative position of the drive element of the actuator. The control information includes an absolute position of the drive element, which is calculated by adding the change in the relative position to a reference position in accordance with an output of the sensor. In the event that the absolute position calculated with respect to a first bank of the plurality of banks becomes unknown, the control device provisionally sets the absolute position to a value of a first operational limit of the drive element that provides the lowest lift of the intake valve, operates the actuator to gradually increase the lift until the drive element reaches a second operational limit, which provides the highest lift of the intake valve, and learns a first reference position as the absolute position when the drive element reaches the second operational limit, and the control device causes the actuator to operate the drive element for another bank of the plurality of banks, in which the absolute position is known, so that the drive element moves within a specified range between the first and second operational limits, in accordance with the movement of the drive element for the first bank.

Furthermore, each of the variable valve actuating mechanisms may include a variable valve-timing mechanism capable of advancing or retarding the opening timing of each intake valve. The control device causes the variable valve timing mechanisms for the first and second banks to hold the opening timing at a specified middle position during an operation for learning the first reference position.

Furthermore, each of the variable valve actuating mechanisms may move the drive element to increase the lift as the maximum lift amount of each of the intake valves and increase the duration of the crank angle, which the intake valve is open.

According to the above aspect of the invention, even if a learned value or values associated with the variable valve actuating mechanism corresponding to one of the two or more banks is/are cleared, the loss of the learned value(s) has a minimal effect on the operation of the vehicle or the engine.

BRIEF DESCRIPTION OF THE DRAWINGS

The foregoing and/or further objects, features and advantages of the invention will become more apparent from the following description of an exemplary embodiment with reference to the accompanying drawings, in which like numerals are used to represent like elements and wherein.

DETAILED DESCRIPTION OF THE INVENTION

Figure 1:
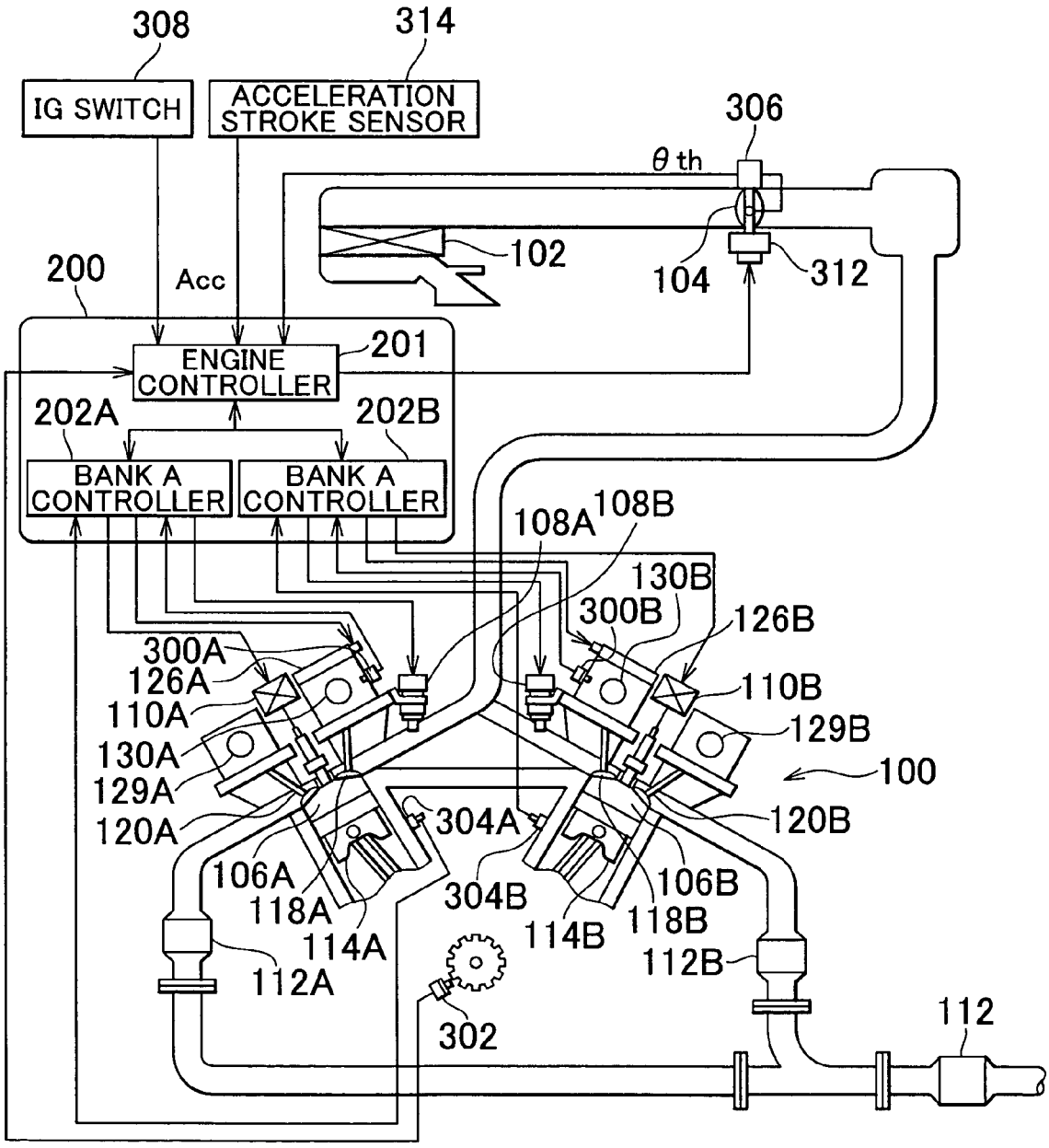
FIG. 1 is a view showing the construction of an engine according to one embodiment of the invention.

An example embodiment of the invention will be described in detail with reference to the accompanying drawings. In the figures, the same reference numerals are used for identifying the same or corresponding components, elements or portions, of which explanation will not be repeated.

FIG. 1 shows an engine 100 that is controlled by a control system according to the exemplary embodiment of the invention. Referring to FIG. 1, a control device 200 is configured to execute programs, as described later, to provide the control system for the internal combustion engine according to this embodiment of the invention.

During operation of the engine 100, air is inducted or drawn into the engine 100 through an air cleaner 102. A throttle valve 104 is provided for controlling the amount of intake air drawn into the engine 100. The throttle valve 104 may be an electrically controlled throttle valve that is driven by a throttle motor 312.

The engine 100 may be a V-type engine, which includes two banks A, B. In the following description, the reference numerals assigned to elements or components of the bank A are followed by A, and those assigned to elements or components of the bank B are followed by B.

The air that passes through the throttle valve 104 is directed in two directions to be drawn into the two banks A, B. The air is then mixed with fuel in intake ports located just ahead of cylinders (combustion chambers) 106A, 106B as viewed in the direction of flow of the intake air. The fuel is injected from injectors 108A, 108B into the intake ports of the banks A, B, respectively.

The fuel is injected on the intake stroke. However, the timing of fuel injection is not limited to the intake stroke. While the engine 100 of this embodiment is provided with the injectors 108A, 108B adapted for port injection, the invention may be applied to a direct injection type engine provided with injectors having injection holes that are open to the combustion chambers 106A, 106B, respectively. The invention may also be applied to an engine provided with injectors adapted for port injection and injectors adapted for direct injection.

Ignition plugs are connected to ignition coils 110A, 110B, and are exposed to the combustion chambers in the cylinders 106A, 106B. The air-fuel mixture in the cylinders 106A, 106B is ignited by the ignition plugs. Streams of the burned air-fuel mixture, or exhaust gas, are cleaned up with three-way catalysts 112A, 112B, and then join together into a single stream. The exhaust-gas stream is further cleaned up with a three-way catalyst 112, and is then discharged out of the vehicle. The combustion of the air-fuel mixture in the cylinders 106A, 106B causes pistons 114A, 114B to be pushed down, thereby rotating the crankshaft.

A pair of intake valves 118A and a pair of exhaust valves 120A are provided in a top portion of the cylinder 106A. In FIG. 1, only one of the intake valves 118A and only one of the exhaust valves 120A are illustrated. The amount of air drawn into the cylinder 106A and the timing of air induction are controlled by the intake valves 118A. The amount of exhaust gas discharged from the cylinder 106A and the timing of discharge are controlled by the exhaust valves 120A. The intake valves 118A are driven or actuated by a cam (not shown in FIG. 1) provided on a camshaft 130A. The exhaust valves 120A are driven or actuated by a cam (not shown in FIG. 1) provided on a camshaft 129A.

A pair of intake valves 118B and a pair of exhaust valves 120B are provided in a top portion of the cylinder 106B. In FIG. 1, only one of the intake valves 118B and only one of the exhaust valves 120B are illustrated. The amount of air drawn into the cylinder 106B and the timing of air induction are controlled by the intake valves 118B. The amount of exhaust gas discharged from the cylinder 106B and the timing of discharge are controlled by the exhaust valves 120B. The intake valves 118B are driven or actuated by a cam (not shown in FIG. 1) provided on a camshaft 130B. The exhaust valves 120B are driven or actuated by a cam (not shown in FIG. 1) provided on a camshaft 129B.

The timing of the opening and closing, lift and duration for each intake valve 118A, 118B are respectively controlled by VVTL (Variable Valve Timing and Lift) mechanisms 126A, 126B. The timing of the opening and closing of the exhaust valves 120A, 120B may be controlled by respective VVT (Variable Valve Timing) mechanisms, or the timing of the opening and closing, lift and duration of the exhaust valves 120A, 120B may be controlled by respective VVTL mechanisms.

Each of the VVTL mechanisms 126A, 126B is a combination of a VVT (Variable Valve Timing) mechanism for controlling the timing of the opening and closing of the intake valves and a VVL (Variable Valve Lift) mechanism for controlling the lift and duration of the intake valves. The VVL mechanism may control one of the lift and the duration.

In this embodiment, the VVT mechanisms rotate the cams in a controlled manner to control the timing of the opening and closing of the intake valves 118A, 118B. It is, however, to be understood that the method of controlling the timing of the opening and closing of the valves is not limited to this method. The VVT mechanism may utilize any of the technologies conventionally used, and, therefore, detailed description of the VVT mechanism will not be provided herein. The VVL mechanism will be described later.

The control device 200 controls the throttle opening θth, the ignition timing, fuel injection timing and fuel injection quantity of each bank A, B, and the operating conditions (the timing of opening and closing, lift, duration, etc.) of the intake valves to bring the engine 100 into desired operating conditions. The control device 200 receives signals from cam angle sensors 300A, 300B, a crank angle sensor 302, knock sensors 304A, 304B, a throttle position sensor 306, an ignition switch 308 and an acceleration stroke sensor 314.

The cam angle sensors 300A, 300B generate signals that indicate the positions of the cams on the camshafts 103A, 103B. The crank angle sensor 302 generates a signal that indicates the rotational speed of the crankshaft (or engine speed (RPM)) and the angle of rotation of the crankshaft. The knock sensors 304A, 304B generate signals that indicate the intensity or magnitude of vibrations of the engine 100. The throttle position sensor 306 generates a signal that indicates the throttle opening θth. The ignition switch 308 generates a signal that indicates the ignitions switch is ON state when a driver of the vehicle turns on the ignition switch 308. The acceleration stroke sensor 314 generates a signal that indicates an accelerator pedal position or pedal travel Acc representing the amount the accelerator pedal is depressed by the driver.

The control device 200 controls the engine 100 on the basis of the signals received from the above-mentioned sensors, and maps and programs stored in a memory (not shown).

The control device 200 includes a bank A controller 202A that controls the VVL mechanism 126A for the bank A in response to the sensor signals associated with the bank A, a bank B controller 202B that controls the VVL mechanism 126B for the bank B in response to the sensor signals associated with the bank B, and an engine controller 201 that performs control common to the banks A and B in response to sensor signals associated with both of the banks A and B.

Figure 2:
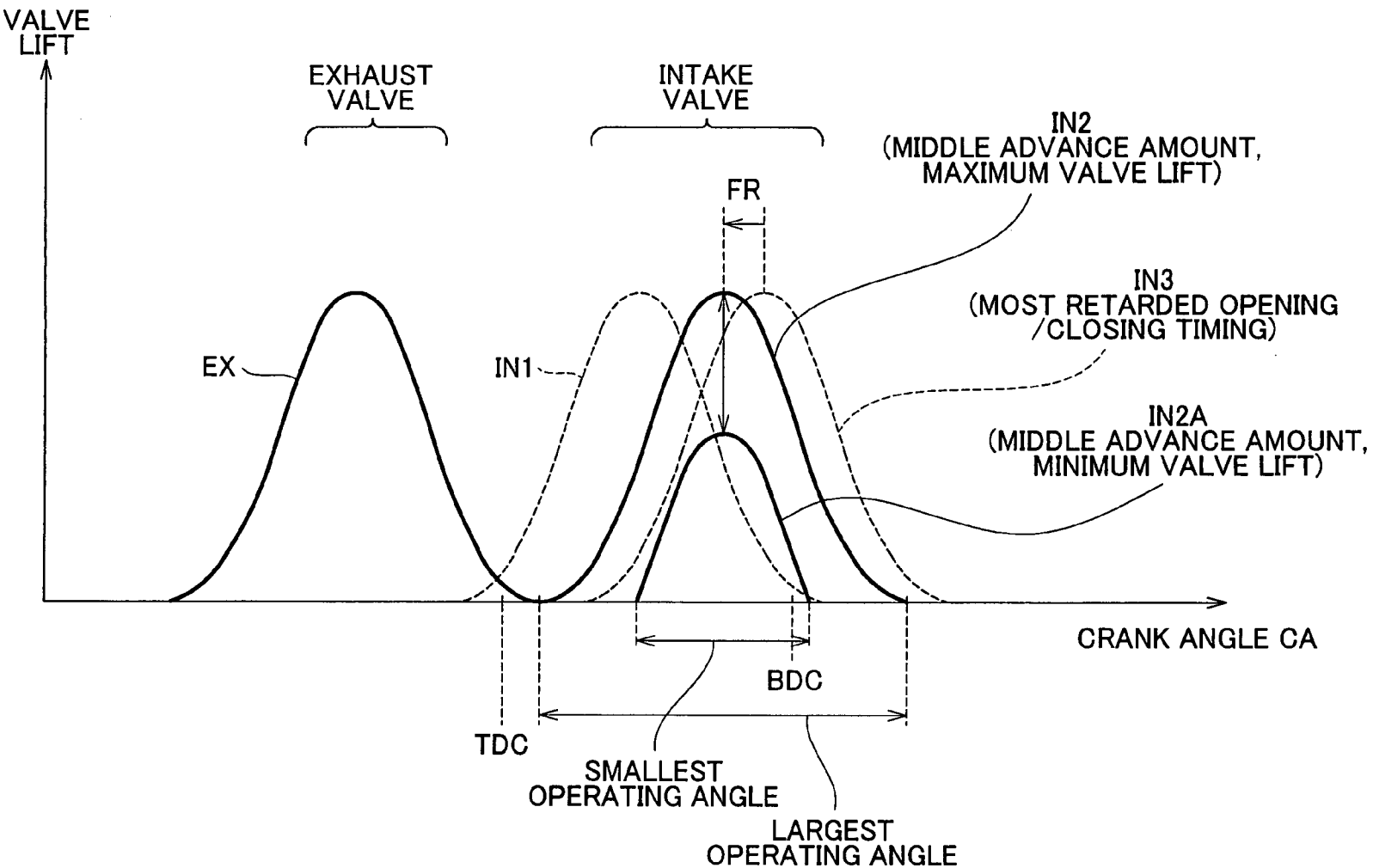
FIG. 2 is a graph indicating some examples of the relationship between the lift amount of valves and the crank angle, which are established by a variable valve actuating mechanism.

FIG. 2 illustrates some examples of the relationship between the amount of lift of each valve and the crank angle, which can be established by variable valve actuating mechanisms (e.g., VVTL mechanisms). The following description referring to FIG. 2 through FIG. 5 is concerned with both of the bank A and the bank B, and, therefore, letter A or B is not assigned to the reference numeral for each component or element shown in these figures.

Referring to FIG. 2, the exhaust valve opens and closes on the exhaust stroke, and the intake valve opens and closes on the intake stroke. In FIG. 2, waveform EX indicates how the amount of lift of the exhaust valve changes with respect to the crank angle, and waveforms IN1-IN3, IN2A indicate some examples each indicating how the amount of lift of the intake valve changes with respect to the crank angle.

The VVT mechanism changes the timing of the opening and closing of the intake valve among the waveforms IN1-IN3. Assuming that the waveform IN3 represents the most retarded intake opening and closing, the amount of advance is defined in terms of the crank angle with reference to the peak of the waveform IN3, as indicated by arrow FR in FIG. 2.

In FIG. 2, TDC denotes the top dead center of the piston in question, and BDC denotes the bottom dead center of the piston. The period including the piston top dead center (TDC) and its vicinity, in which both of the exhaust valve and the intake valve are open, is called "valve overlap". The VVT mechanism is able to adjust the period of the "valve overlap". As the overlap period increases, an increased amount of fresh air is inducted into the engine, which improves engine output or power during high-speed rotation, but exhaust gas may be reintroduced into the cylinder (combustion chamber) during low-speed rotation, which would cause unstable combustion.

The duration and lift of the intake valve, may be varied within a specified range. The "lift" means the amount of lift of each valve, which corresponds to the peak of the waveform showing changes in the amount of lift of the valve. More specifically described with reference to FIG. 2, the lift may be varied between the maximum lift provided by the waveform IN2 and the minimum lift provided by the waveform IN2A. The crank angle over which the intake valve is open (i.e., the crank angle between a point at which the intake valve opens and a point at which the intake valve closes) is called the "duration". As shown in FIG. 2, the waveform IN2 provides the longest duration, and the waveform IN2A provides the shortest duration. Namely, the duration may be varied between the longest duration, provided by the waveform IN2, and the shortest duration, provided by the waveform IN2A.

Figure 3:
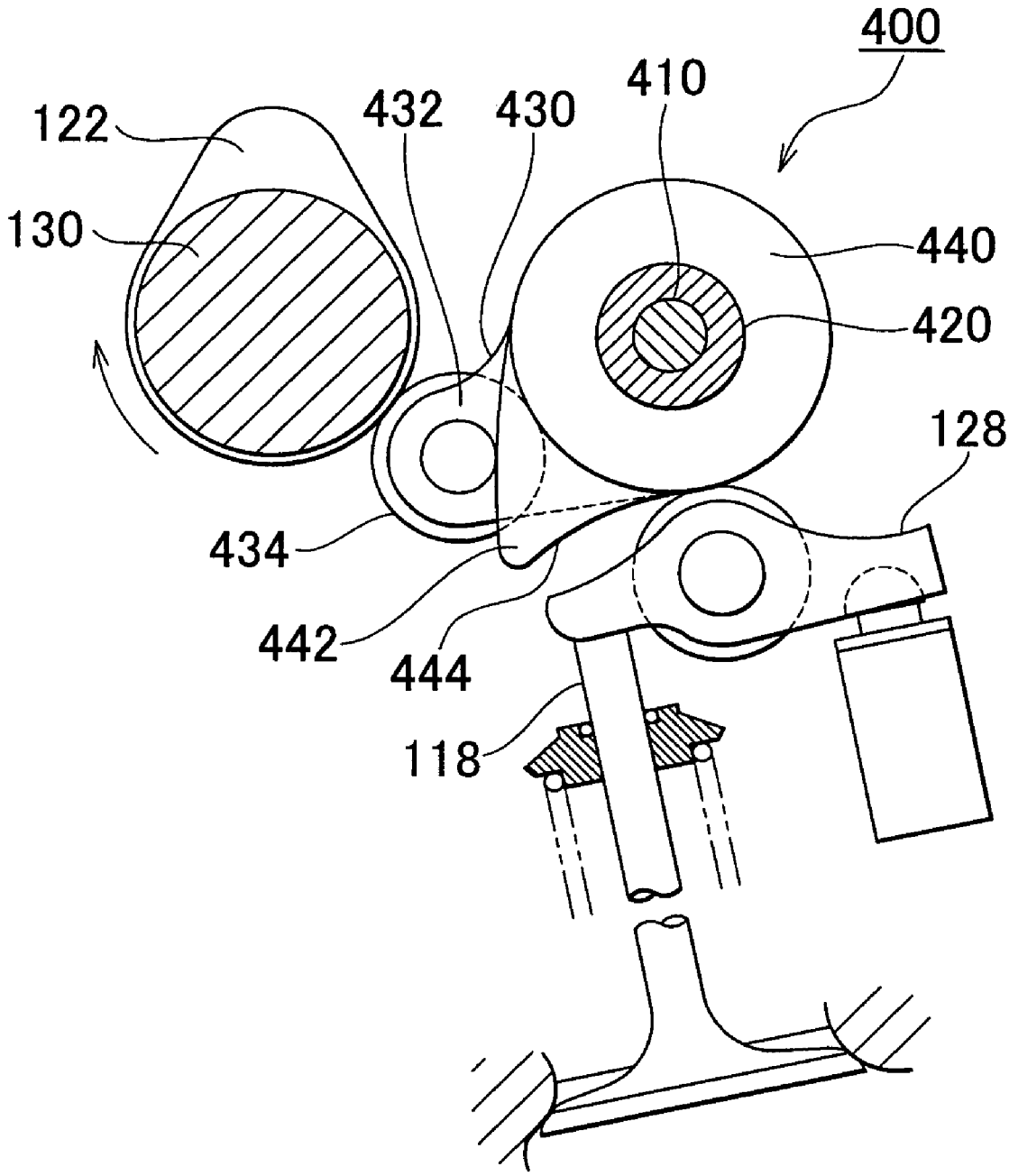
FIG. 3 is a front view of a VVL mechanism that controls the lift and duration of an intake valve.

FIG. 3 is a front view of the VVL mechanism 400 that controls the lift and duration of the intake valves.

Referring to FIG. 3, the VVL mechanism 400 includes a drive shaft 410 that extends in one direction (i.e., in the direction perpendicular to the plane of FIG. 3), a support pipe 420 that covers the outer circumferential surface of the drive shaft 410, and one input arm 430 and two oscillating cams 440 for each cylinder. The input arm 430 and the oscillating cams 440 are arranged in the axial direction of the drive shaft 410 on the outer circumferential surface of the support pipe 420. An actuator for linearly moving the drive shaft 410 is connected to the distal end of the drive shaft 410.

In the VVL mechanism 400, one input arm 430 is arranged to face one cam 122 provided for each cylinder, and two oscillating cams 440 are disposed on the opposite sides of the input arm 430 in association with a pair of intake valves 118 provided for each cylinder.

The support pipe 420 has a hollow, cylindrical shape, and is arranged in parallel with the camshaft 130. The support pipe 420 is fixed to the cylinder head so that it does not rotate or move in the axial direction.

The drive shaft 410 is inserted in the support pipe 420 such that the drive shaft 410 is slidable in the axial direction thereof. The input arm 430 and two oscillating cams 440 are provided on the outer circumferential surface of the support pipe 420 such that the arm and cams 430, 440 may oscillate or pivot about the axis of the drive shaft 410 but are inhibited from moving in the axial direction.

The input arm 430 has a pair of arm portions 432 that protrude away from the outer circumferential surface of the support pipe 420, and a roller portion 434 that is rotatably connected to the distal ends of the arm portions 432. The input arm 430 is positioned such that the roller portion 434 rides on or contacts with the cam 122.

Each of the oscillating cams 440 has a generally triangular nose portion 442 that protrudes away from the outer circumferential surface of the support pipe 420. The nose portion 442 is formed at its one side with a cam face 444 that is curved into a concave face. A roller that is rotatably attached to a rocker arm 128 is pressed against the cam face 444 under the bias force of a valve spring provided on the corresponding intake valve 118.

The input arm 430 and the oscillating cams 440 are arranged to oscillate as a unit about the axis of the drive shaft 410. When the camshaft 130 rotates, therefore, the input arm 430 oscillates while riding on the cam 122, and the oscillating cams 440 also oscillate in accordance with the movement of the input arm 430. The movements of the oscillating cams 440 are then transmitted to the intake valves 118 via the rocker arms 128, so that the intake valves 118 open and close.

The VVL mechanism 400 further includes a mechanism for changing the relative phase difference between the input arm 430 and the oscillating cams 440 about the axis of the support pipe 420. The mechanism for changing the relative phase difference operates to change the lift and duration of the intake valves 118 as desired.

More specifically, if the above-mentioned mechanism increases the relative phase difference between the input arm 430 and the oscillating cams 440, the angle of oscillation of the rocker arms 128 relative to the angle of oscillation of the input arm 430 and oscillating cams 440 increases, so that the lift and duration of the intake valves 118 will be increased.

If the relative phase difference between the input arm 430 and the oscillating cams 440 is reduced, on the other hand, the angle of oscillation of the rocker arms 128 relative to the angle of oscillation of the input arm 430 and oscillating cams 440 is reduced, so that the lift and duration of the intake valves 118 will be reduced.

Figure 4:
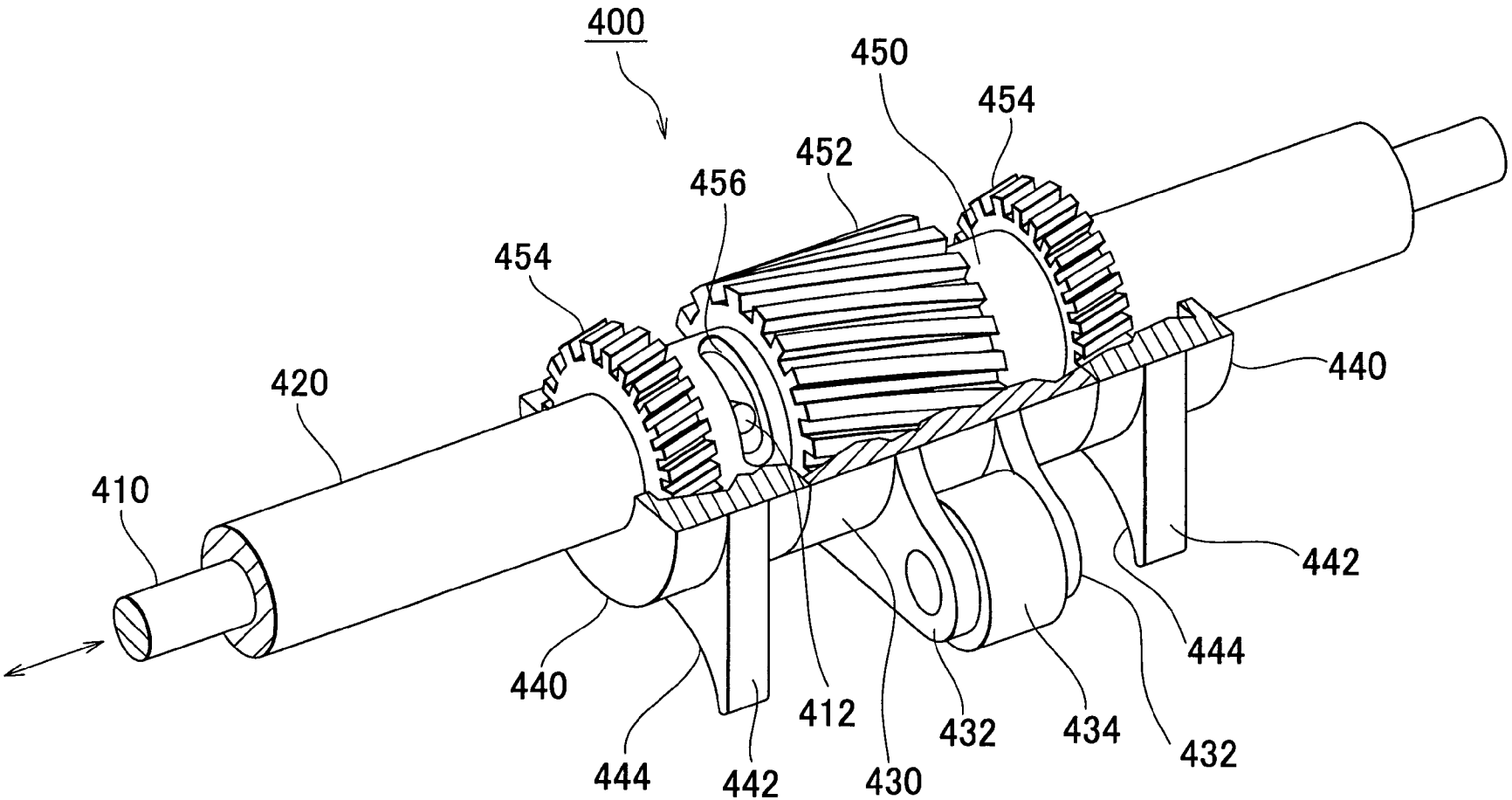
FIG. 4 is a perspective view showing a part of the VVL mechanism.

FIG. 4 is a perspective view showing a part of the VVL mechanism. FIG. 4 is also a cutaway view showing the internal structure of a certain portion of the mechanism for to clarify the structure of the mechanism.

Referring to FIG. 4, a slider gear 450 is accommodated in a space defined by the input arm 430, two oscillating cams 440 and the outer circumferential surface of the support pipe 420. The slider gear 450 is supported on the support pipe 420 such that the gear 450 rotates about the axis of the pipe 420 and slides in the axial direction.

The slider gear 450 includes a helical gear 452 that is located in an axially middle portion of the gear 450 and is formed with helical splines in the shape of right-hand teeth. The slider gear 450 also includes a pair of helical gears 454 that are located on the axially opposite sides of the helical gear 452 and are formed with helical splines in the shape of left-hand teeth.

On the other hand, helical splines that face the helical gears 452, 454 are formed on the inner circumferential surfaces of the input arm 430 and two oscillating cams 440 that define the space in which the slider gear 450 is received. More specifically, the input arm 430 is formed with helical splines in the shape of right-hand teeth, which mesh with the helical splines of the helical gear 452. Each of the oscillating cams 440 is formed with helical splines in the shape of left-hand teeth, which mesh with the helical splines of the corresponding helical gear 454.

The slider gear 450 is formed with a long hole or slot 456 that is located between one of the helical gears 454 and the helical gear 452 and extends in the circumferential direction. In addition, a long hole or slot (not shown) that extends in the axial direction is formed in the support pipe 420 such that the slot overlaps the slot 456 of the slider gear 450. The drive shaft 410 inserted through the support pipe 420 is formed integrally with an engagement pin 412 that protrudes through the overlapping portions of the slot 456 and the slot (not shown) of the support pipe 420.

When the drive shaft 410 moves in the axial direction, the engagement pin 412 pushes the slider gear 450, and the helical gears 452 and 454 move at the same time in the axial direction of the drive shaft 410. With the helical gears 452 and 454 thus moved, the input arm 430 and oscillating cams 440 that engage with the helical gears 452, 454 via the splines do not move in the axial direction. Rather, the input arm 430 and the oscillating cams 440 rotate about the axis of the drive shaft 410 through the engagement of the helical splines.

Because the direction of the helical splines formed on the input arm 430 is opposite to the direction of the helical splines formed on the oscillating cams 440, the input arm 430 and the oscillating cams 440 rotate in the opposite directions. As a result, the relative phase difference between the input arm 430 and the oscillating cams 440 changes, and the lift and duration of the intake valves 118 are changed as explained above. However, the VVL mechanism is not limited to this type of arrangement.

Figure 5:
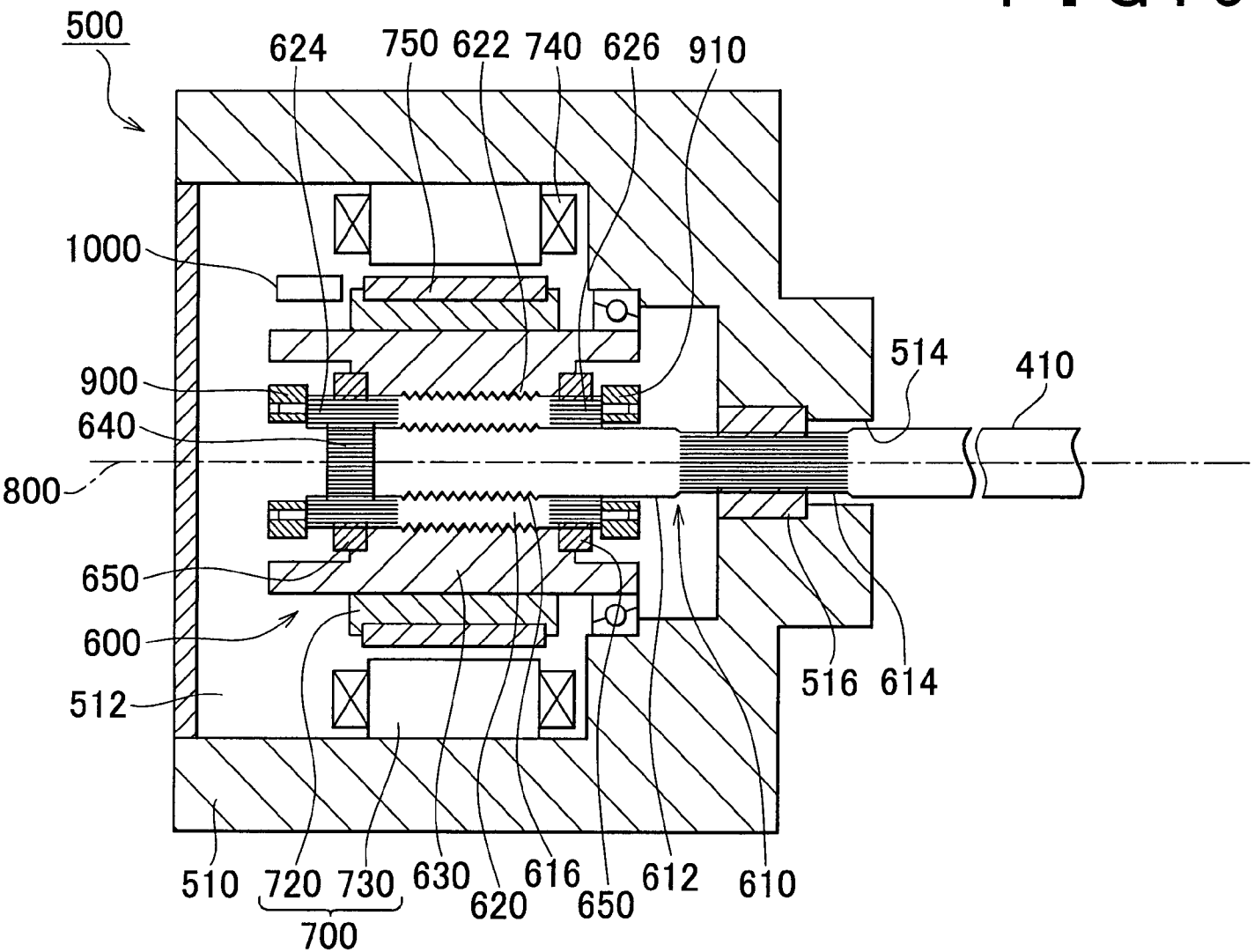
FIG. 5 is a cross-sectional view showing an actuator that linearly moves a drive shaft of the VVL mechanism in the axial direction thereof.

FIG. 5 is a cross-sectional view showing an actuator 500 for linearly moving the drive shaft 410 of the VVL mechanism 400 in the axial direction.

Referring to FIG. 5, the actuator 500 includes a housing 510 that defines a space 512, a differential roller gear 600 that is disposed in the space 512 and converts rotary motion to linear motion, and a motor 700 that generates rotary motion to the differential roller gear 600. The housing 510 is formed with an opening 514 that is open to the cylinder head in which the VVL mechanism 400 is provided.

The differential roller gear 600 includes a sun shaft 610 that extends on an axis 800 as indicated by a one-dot chain line in FIG. 5, a plurality of planetary shafts 630, and a nut 630 having a cylindrical shape. The planetary shafts 620 extend in parallel with the axis 800 on the outer circumferential surface 612 of the sun shaft 610, and are arranged at certain spacings about the axis 800 in the circumferential direction. The nut 630 surrounds the planetary shafts 630, and extends along the axis 800 on which the center of the nut 630 is located.

The sun shaft 610 is aligned with the drive shaft 410 on the axis 800. The sun shaft 610 protrudes from the space 512 outwardly of the housing 510 through the opening 514. The sun shaft 610 is connected to the drive shaft 410 with a coupling, or the like, which is not illustrated.

The sun shaft 610 has a splined portion 614 formed with splines, and a threaded portion 616 formed with a male screw. A ring-like sun gear 640 is fitted on an axial end portion of the sun shaft 610 in the space 512. The sun gear 640 is formed at its outer circumferential surface with a spur gear having teeth arranged about the axis 800 in the circumferential direction.

An anti-rotation collar 516 is fixed to the housing 510 at a location surrounding the splined portion 614 of the sun shaft 610. The anti-rotation collar 516 is formed at its inner circumferential surface with splines. With the anti-rotation collar 516 engaging with the splined portion 614, the sun shaft 610 is inhibited from rotating about the axis 800.

Retainers 900 and 910, each having an annular shape with its center located on the axis 800, are respectively disposed on the opposite sides of the planetary shafts 620. The planetary shafts 620 are rotatably supported at their opposite ends by the retainers 900 and 910. The retainers 900 and 910 are coupled to each other by means of supports that are arranged about the axis 800 at certain spacings in the circumferential direction and extend in parallel with the planetary shafts 620.

Each of the planetary shafts 620 has a threaded portion 622, and gear portions 624 and 626 formed on the opposite sides of the threaded portion 622. The threaded portion 622 of the planetary shaft 620 is formed with a male screw that meshes with a male screw formed in the threaded portion 616 of the sun shaft 610 and a female screw formed in the inner circumferential surface of the nut 630. The male screw formed in the threaded portion 622 of the planetary shaft 620 extends in the reverse direction with respect to the male screw formed in the threaded portion 616 of the sun shaft 610, and extends in the same direction as the female screw formed in the inner circumferential surface of the nut 630.

The gear portion 624 of the planetary shaft 620 is formed with a spur gear that meshes with the spur gear formed in the outer circumferential surface of the sun gear 640 and a spur gear formed in the inner circumferential surface of a ring gear 650 (which will be described later). Similarly, the gear portion 626 of the planetary shaft 620 is formed with a spur gear that meshes with a spur gear formed in the inner circumferential surface of another ring gear 650 (which will be described later).

The nut 630 is supported on the housing 510 with a bearing fixed to the housing 510 such that the nut 630 is freely rotatable about the axis 800. The nut 630 is formed at its inner circumferential surface with the female screw that extends in the direction opposite to the direction of the male screw formed in the threaded portion 616 of the sun shaft 610.

The above-mentioned ring gears 650 are fixed to the nut 630 to be located on the axially opposite sides of the inner circumferential surface in which the female screw is formed. Each of the ring gears 650 is formed at its inner circumferential surface with the spur gear having teeth arranged about the axis 800 in the circumferential direction thereof.

The male screw formed in the threaded portion 616 of the sun shaft 610, male screws formed in the threaded portions 622 of the planetary shafts 620 and the female screw formed in the inner circumferential surface of the nut 630 are all multiple thread screws or multiple-start threads having the same pitch. In this embodiment, in order to move the sun shaft 610 in the direction of the axis 800, the number of thread-turns of each screw is determined so as to satisfy the relationship that Ns:Np:Nn=(Ds+1):Dp:Dn, for example, where Ds, Dp and Dn represent the pitch diameters of the male screw of the sun shaft 610, male screws of the planetary shafts 620 and the female screw of the nut 630, respectively, and Ns, Np and Nn represent the number of thread-turns of the respective screws. The pitch diameters and the number of thread-turns of the respective screws may have other relationships than that indicated above.

The motor 700 consists principally of a rotor 720 and a stator 730. The rotor 720 is fixed to the outer circumferential surface of the nut 630 by suitable methods or means, such as shrinkage fitting, press fitting, or an adhesive, or other means. The stator 730 around which a coil 740 is wound is fixed to the housing 510 by similar means.

The stator 730 is formed in an annular shape with its center located on the axis 800 so as to surround the rotor 720. The rotor 720 is positioned so as to provide a specified clearance between the rotor 720 and the stator 730, such that the clearance extends about the axis 800 in the circumferential direction. Permanent magnets 750 are mounted on the rotor 720 at its locations facing the stator 730, such that the magnets 750 are arranged about the axis 800 at intervals of a specified angle. By applying electric current to the coil 740, a magnetic field is produced between the rotor 720 and the stator 730. As a result, the rotor 720 rotates about the axis 800 along with the nut 630.

When the nut 630 rotates, the rotary motion is transmitted to the planetary shafts 620 due to the engagement of the screws formed on the nut 630 and planetary shafts 620. At this time, the spur gears formed in the gear portions 624 of the planetary shafts 620 mesh with the spur gears formed in the outer circumferential surface of the sun gear 640 and the inner circumferential surface of the ring gear 650. Also, the spur gears formed in the gear portions 626 of the planetary shafts 620 mesh with the spur gear formed in the inner circumferential surface of the other ring gear 650.

With the above arrangement, the planetary shafts 620 rotate about the axis 800 while rotating about their own axes, without moving in the direction of the axis 800. At the same time, the planetary shafts 620 are held in parallel with the axis 800 due to the engagement of the above-described spur gears.

The rotary motion of the planetary shafts 620 is transmitted to the sun shaft 610 due to the engagement of the screws formed on the planetary shafts 620 and the sun shaft 610. Since the anti-rotation collar 516 inhibits the sun shaft 610 from rotating about the axis 800, the sun shaft 610 moves only in the direction of the axis 800. As a result, the drive shaft 410 is linearly moved, and the lift and duration of the intake valves 118 are changed as described above.

A sensor 1000 is provided for detecting the amount of operation (i.e., the number of rotation or angle of rotation) of the motor 700 (or rotor 720). The sensor 1000 transmits a signal that indicates the result of detection to the control device 200. In this embodiment, the control device 200 indirectly determines the lift and duration of the intake valves 118 from the amount of operation of the motor 700, using a map defining the relationship(s) between the amount of operation of the motor 700 and the lift and duration of the intake valves 118.

By changing the duty cycle of the control signal transmitted from the control device 200 to the motor 700 serving as an actuator, the motor 700 is able to hold the drive shaft 410 as a drive element in a neutral condition, or change the position of the drive shaft 410 toward the maximum-lift end at which the maximum lift is achieved or the minimum-lift end at which the minimum lift is achieved.

On the contrary, the force applied from the drive shaft 410 in the direction of the axis 800 does not cause the motor 700 to rotate. This is because the threaded portion 616 of the sun shaft 610 meshes with the threaded portions of the planetary shafts 620, and the threaded portions of the planetary shafts 620 mesh with the internally threaded portion 622 (the female screw) of the nut 630 on the side opposite to the sun shaft 610, while the nut 630 is inhibited from moving in the direction of the axis 800.

When the force applied from the drive shaft 410 in the direction of the axis 800 is transmitted from the thread of the sun shaft 610 to the threads of the planetary shafts 620, the same force is received by side faces of the threads of the planetary shafts 620 in directions substantially perpendicular to the planes of the side faces. Accordingly, substantially no force for rotating the planetary shafts 620 is produced. As described above, the sun shaft 610 moves in the direction of the axis 800 when current is applied to the motor 700 so as to force the planetary shafts 620 to rotate through the use of the spur gears of the gear portions 624, 626 of the planetary shafts 620. However, the sun shaft 610 does not move and the current position of the drive shaft 410 is maintained when the power supply for the motor 700 is in the OFF state, for example, since the positions of the planetary shafts 620 are fixed due to internal frictions.

The sensor 1000 may be in the form of a sensor, such as a rotary encoder, which generates pulses. Immediately after the ignition key is turned on, the control device 200 counts the pulses so as to learn the positions of the maximum and minimum lift ends of the drive shaft 410 as reference values. The control device 200 then adds a count value of the pulses to the reference values so as to provide an duration sensor value VC that corresponds to the current displacement of the drive shaft 410.

The duration sensor value VC is cleared, for example, when the power supply for the control device 200 is turned off, or large electric noise is applied to the control device 200.

Figure 6:
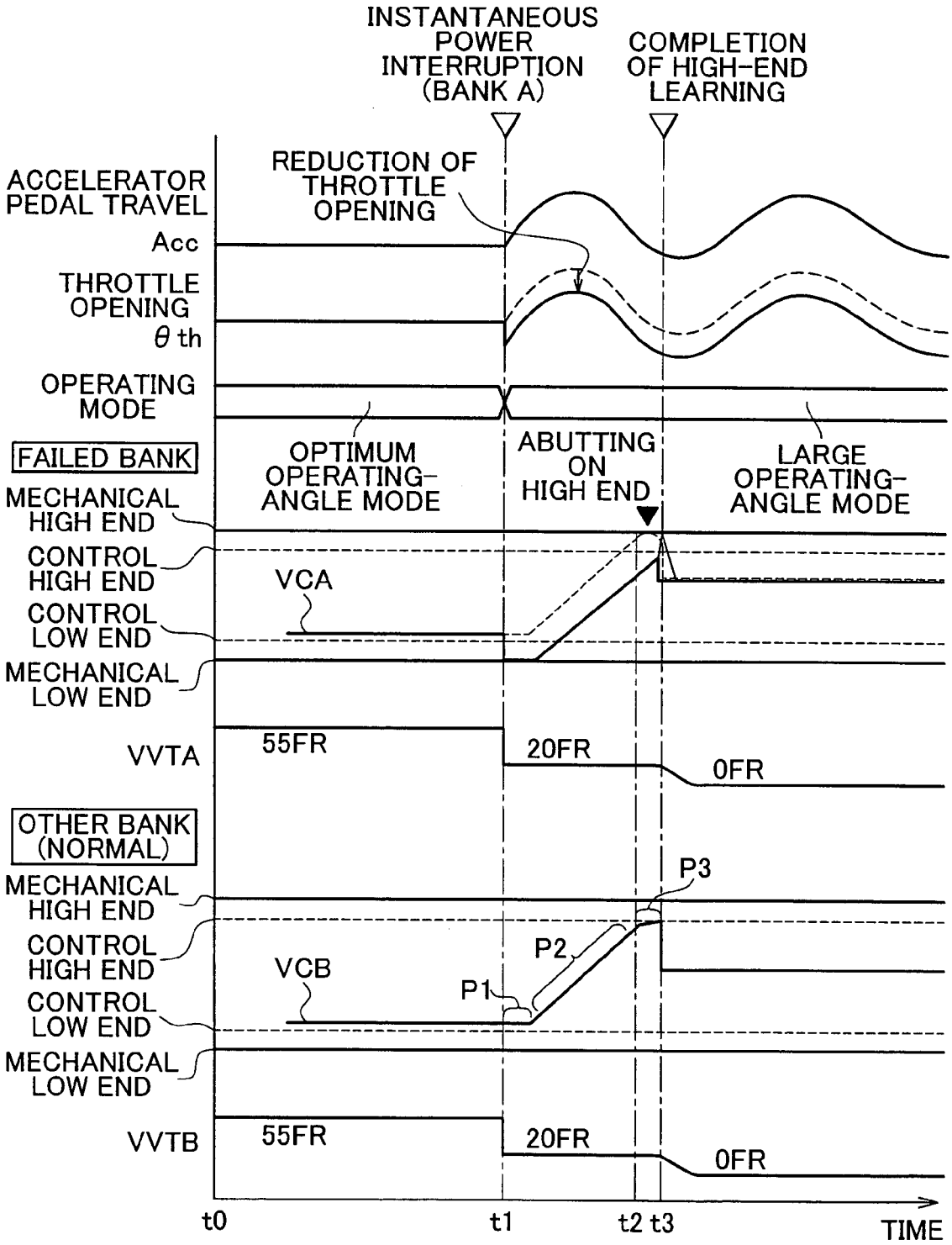
FIG. 6 is a first operation waveform diagram used for explaining re-learning performed after a learned value or values of the variable valve actuating mechanism is/are cleared.

FIG. 6 is a first operation waveform diagram used for explaining re-learning performed after a learned value or values of the variable valve actuating mechanism (e.g., VVL or VVTL mechanism) is/are cleared.

Figure 7A:
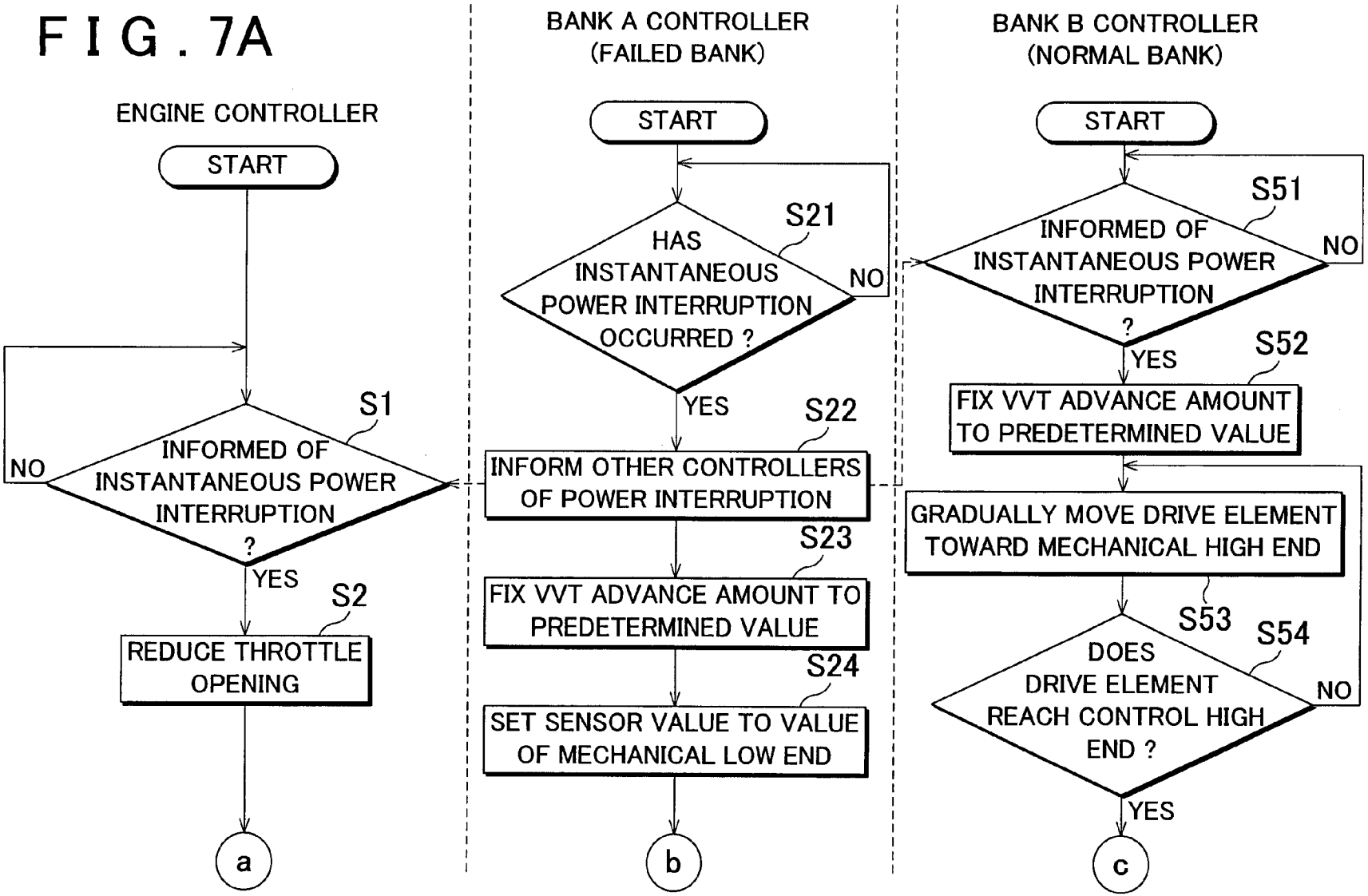
FIGS. 7A and 7B are a set of flowcharts illustrating a re-learning process executed by a control device for re-learning the position of the maximum lift end of a drive element driven by an actuator.
Figure 7B:
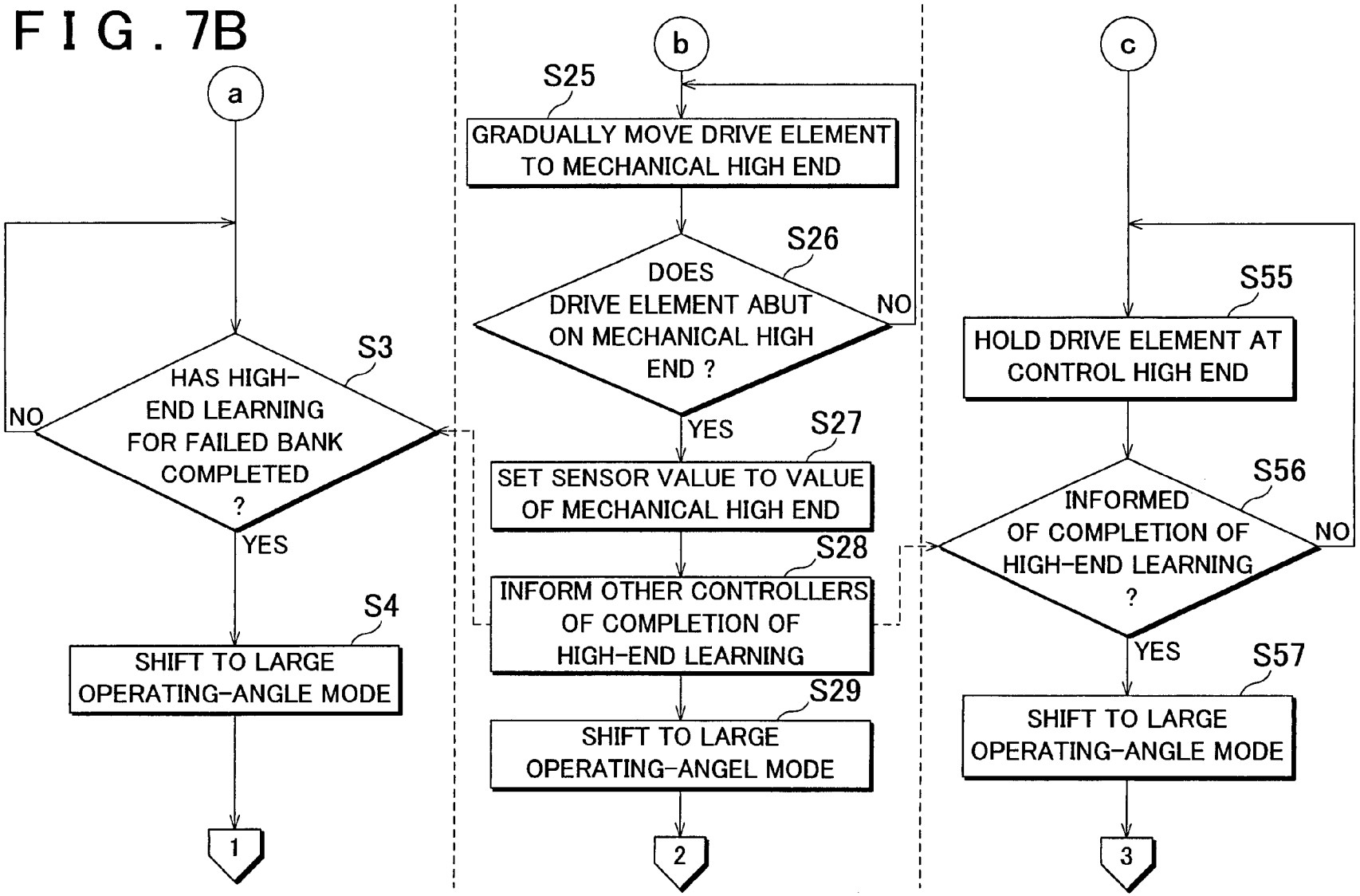

FIGS. 7A and 7B are a set of flowcharts used for explaining a re-learning process executed by the control device 200 for re-learning the position of the maximum lift end of the drive element driven by the actuator. In FIGS. 7A and 7B, the flowcharts of control processes respectively performed by the engine controller 201, bank A controller 202A and the bank B controller 202B of FIG. 1 are illustrated side by side.

Referring to FIG. 6 and FIGS. 7A and 7B, during the period between time t0 and time t1, the vehicle operates in an optimum duration mode in which the optimum duration is determined based on driver's demands on the vehicle, such as an accelerator pedal position or travel, using learned values acquired when the ignition switch is turned on. In the period between t0 and t1, it is determined in step S21 that no instantaneous power interruption or power failure takes place, and, therefore, step S21 is repeatedly executed. For example, an instantaneous power interruption is detected when the duration falls outside the range 113 to 260 of the crank angle in which the duration is supposed to be, for example, when the duration is cleared to zero.

If the duration sensor value VCA for the bank A is cleared at time t1 due to electric noise, such as an instantaneous power interruption or failure, the bank A controller 202A determines in step S21 that an instantaneous power interruption has occurred, and proceeds to step S22.

In step S22, the bank A controller 202A informs the engine controller 201 and the bank B controller 202B of the occurrence of the instantaneous power interruption at the bank A and the upcoming relearning process. The engine controller 201 receives the information on the instantaneous power interruption at the bank A in step S1, and proceeds to step S2 in response to the information. The bank B controller 202B receives the information on the instantaneous power interruption at the bank A in step S51, and proceeds to step S52 in response to the information.

In step S2, the engine controller 201 controls the throttle opening θth, which has been controlled in accordance with the accelerator pedal position or travel Acc, to reduce the throttle opening θth by some degree.

Each of the bank A controller 202A and the bank B controller 202B fixes the VVT advance amount FR on the intake-valve side of the corresponding bank to a predetermined value in step S23 or step S52, respectively. In the example of FIG. 6, the VVT advance amounts for the banks A, B are both fixed to 20FR. At this VVT position, where no overlap appears between the intake valves and the exhaust valves and no knocking occurs, the engine may not operate at the optimum fuel efficiency, but stable operation of the engine is maintained.

The operating mode in which the throttle opening is reduced and the VVT advance amounts are fixed as described above will be called "long duration mode". In this mode, the amount of reduction of the throttle opening and the VVT advance amount are fixed in accordance with a condition in which the duration is fixed to a large value and the lift (i.e., the maximum amount of lift) of the intake valves is large.

The bank A controller 202A then proceeds to step S24 to stop normal control of the actuator 500 for changing the lift, and set the duration sensor valve VCA to a mechanical "LOW" end (the position of the minimum lift end of the drive shaft 410) as a minimum lift end of the drive element driven by the actuator. With regard to the bank B, the sensor value VCB reached at time t1 is maintained for a certain period P1 as shown in FIG. 6.

Step S24 is followed by step S25 in which the actuator for the bank A is operated to gradually drive the drive shaft 410 toward the mechanical "HIGH" end (the position of the mechanical maximum lift end of the drive shaft 410). In step S26, the bank A controller 202A determines whether the drive shaft 410 abuts on or reaches the mechanical "HIGH" end. If it is determined in step S26 that the drive shaft 410 has not abutted on the mechanical "HIGH" end, the bank A controller 202A returns to step S25 to continue to operate the actuator to drive the drive shaft 410 toward the mechanical "HIGH" end.

During the period between time t1 and time t2 in FIG. 6, steps S25 and S26 are repeatedly executed. During this period, the duration sensor value VC increases while taking a value that is a little smaller than the actual duration as indicated by a broken line in FIG. 6. During this period, the throttle opening θth is controlled to be a little smaller than a value commensurate with the actual accelerator pedal position. Namely, the throttle opening θth is reduced by some degree, as compared with that required by the driver, to reduce the amount of intake air drawn into the engine.

An affirmative decision (YES) is obtained in step S26 when the count value representing the output of the sensor 1000 indicates that the rotation of the rotor 720 of the actuator 500 does not increase any more.

In parallel with the process of step S24 to step S26, the bank B controller 202B carries out the process of step S53 to step S55. In step S53, the actuator for the bank B is operated to gradually drive the drive shaft 410 toward the mechanical "HIGH" end (the position of the mechanical maximum lift end of the drive shaft 410). In step S54, it is determined whether the drive shaft 410 reaches the control "HIGH" end (i.e., the position of the maximum lift end that is supposed to be reached by the drive shaft 410 under control of the controller 202B). If it is determined in step S54 that the drive shaft 410 has not reached the control "HIGH" end, the bank B controller 202B returns to step S53 to continue to operate the actuator to drive the drive shaft 410 toward the mechanical "HIGH" end.

If the bank B controller 202B determines in step S54 that the drive shaft 410 reaches the control "HIGH" end, the controller 202B proceeds to step S55 to stop operating the actuator for the bank B for a period between time t2 and time t3 as shown in FIG. 6, to thus hold the drive shaft 410 at the position of the control "HIGH" end.

If the bank A controller 202A determines in step S26 that the drive shaft 410 for the bank A abuts on the mechanical "HIGH" end at time t3, the controller 202A proceeds to step S27 to set the duration sensor value VCA to a value corresponding to the mechanical "HIGH" end. In the waveform diagram of FIG. 6, the actual duration and the duration sensor value VCA are made equal to each other at time t3.

Upon completion of learning of the mechanical "HIGH" end at time t3, the bank A controller 202A informs the engine controller 201 and the bank B controller 202B in step S28 that the HIGH-end learning process is completed or finished. The bank A controller 202A then proceeds to step S29 to shift to the long duration mode.

The engine controller 201 receives the above information in step S3, and proceeds to step S4 to shift to the long duration mode. Similarly, the bank B controller 202B receives the above information in step S56, and proceeds to step S57 to shift to the long duration mode.

In steps S4, S29 and S57, the operating mode of the engine is shifted or switched to the long duration mode in which the duration is actually fixed to a large value. In the long duration mode established in steps S4, S29 and S57, the lift and the duration are fixed to values close to the maximum values in the operable ranges within which the engine is normally supposed to operate. In this mode, the throttle opening θth continues to be controlled to be a little smaller than a value corresponding to the accelerator pedal position Acc, and the VVT advance amount for the intake valves is changed (reduced) to 0FR and is fixed at this value.

The mechanical HIGH-end learning is completed after execution of steps S4, S29 and S57, and the control proceeds to a mechanical LOW-end learning process as shown in FIG. 9.

Figure 8:
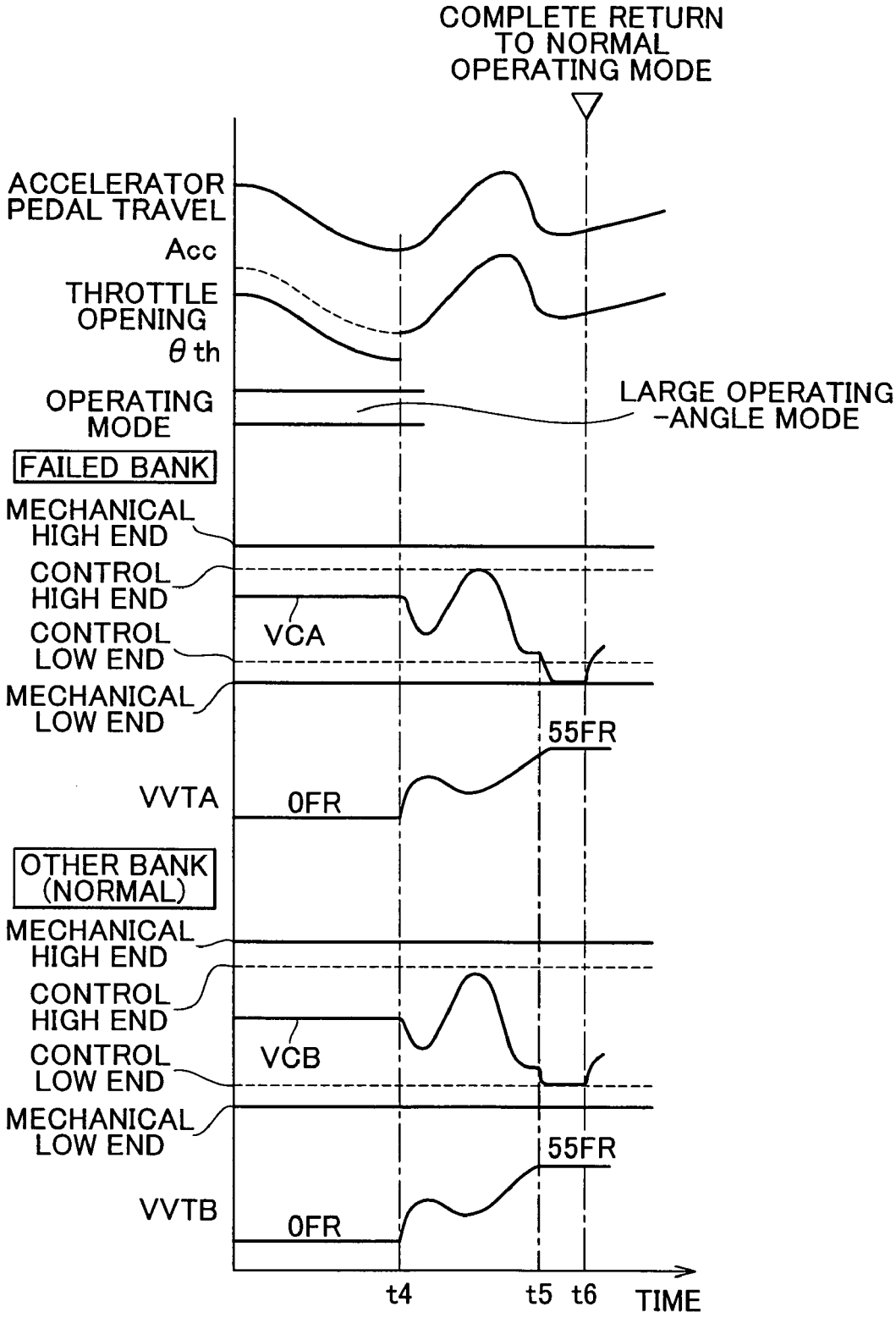
FIG. 8 is a second operation waveform diagram used for explaining a process of learning the mechanical LOW end of the drive element.

FIG. 8 is a second operation waveform diagram used for explaining the process of learning the mechanical LOW-end. The operation waveform diagram of FIG. 8 follows the operation waveform diagram of FIG. 6.

Figure 9A:
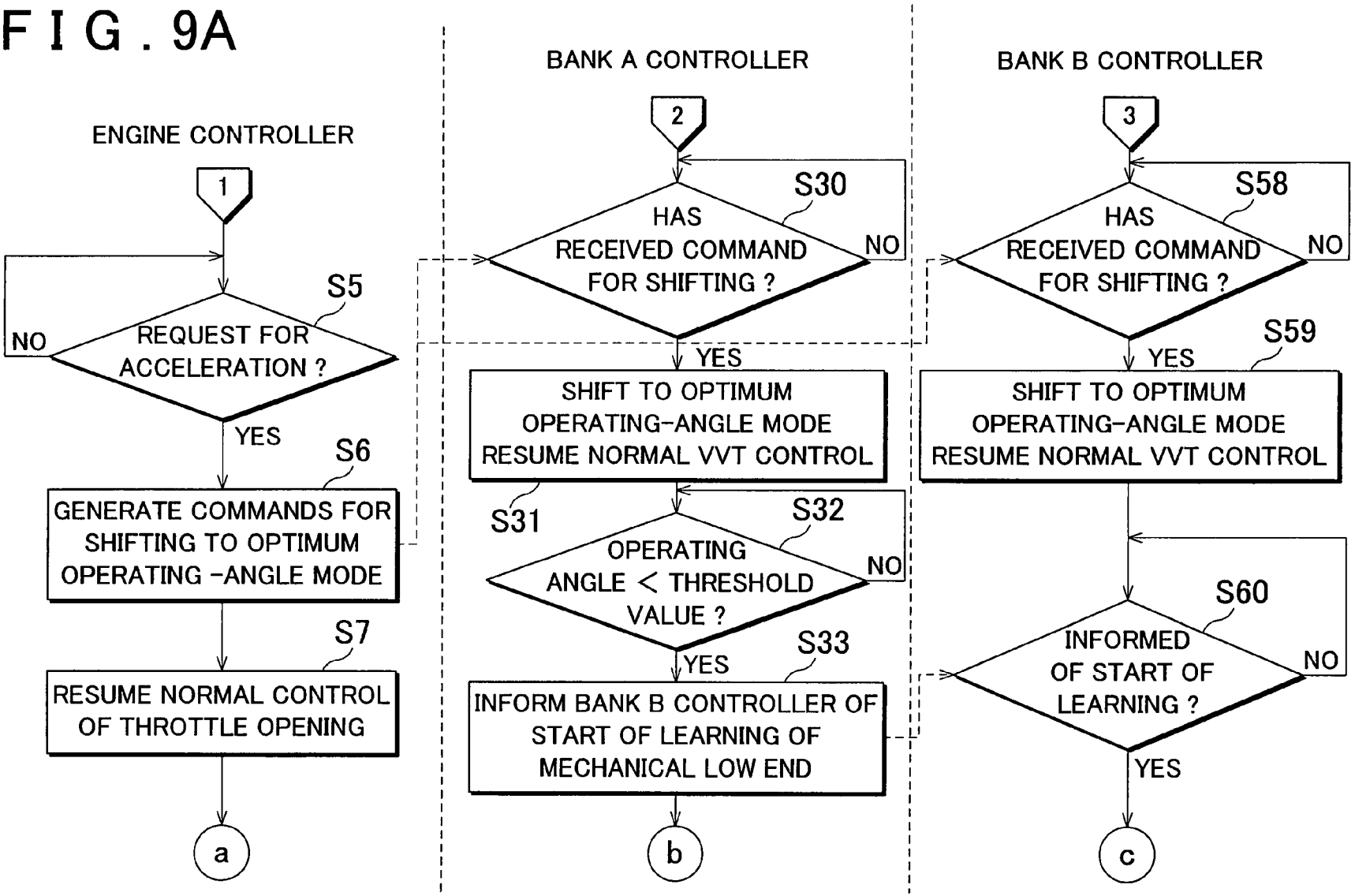
FIGS. 9A and 9B are a set of flowcharts illustrating a process of learning the position of the minimum lift end of the drive element driven by the actuator.
Figure 9B:
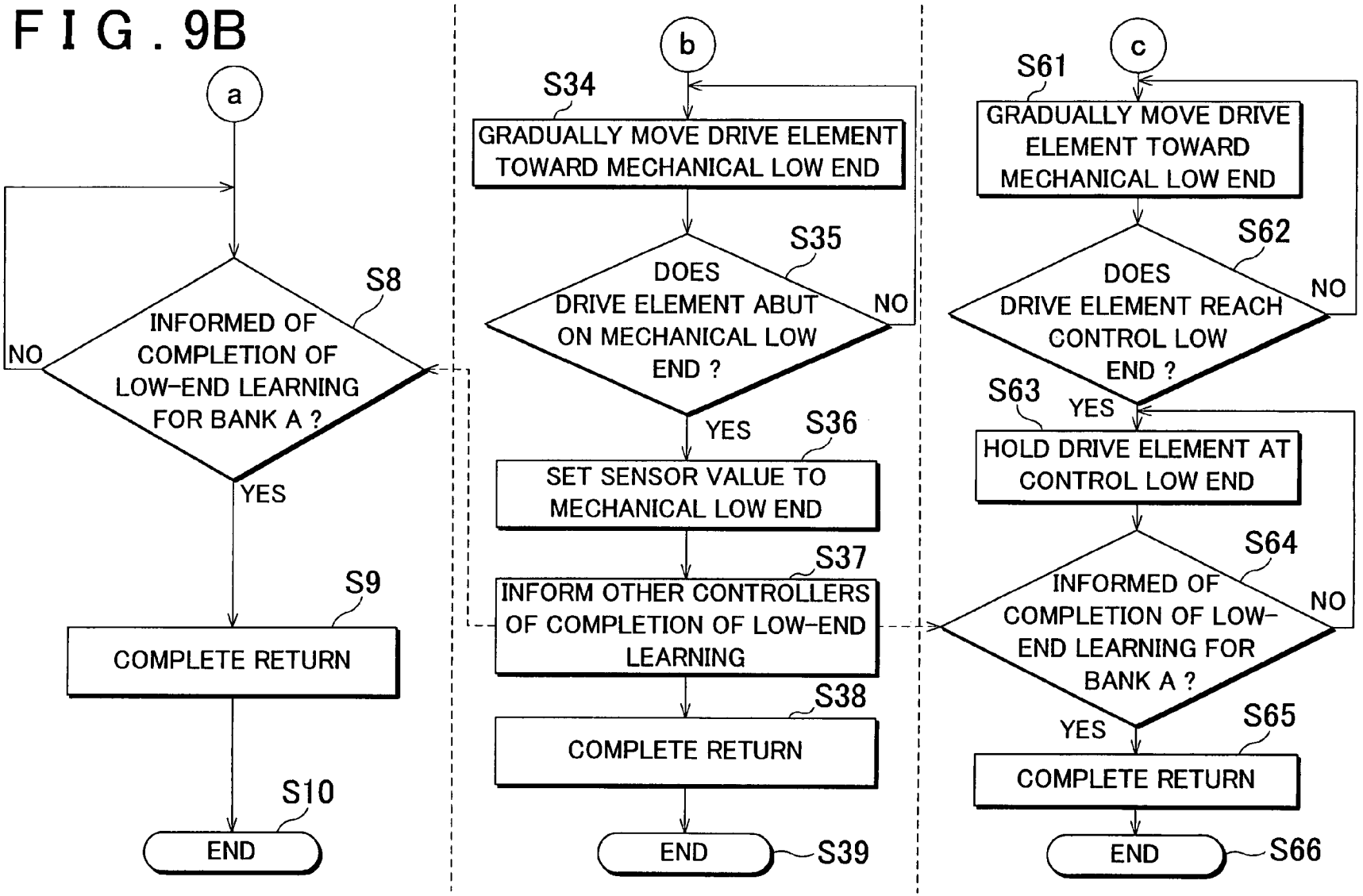

FIGS. 9A and 9B are a set of flowcharts illustrating a re-learning process executed by the control device 200 for re-learning the position of the minimum lift end of the drive element driven by the actuator. In FIGS. 9A and 9B, too, the flowcharts of control processes respectively performed by the engine controller 201, bank A controller 202A and the bank B controller 202B of FIG. 1 are illustrated side by side.

Referring to FIG. 8 and FIGS. 9A and 9B, during operation in the long duration mode up to time t4, the engine controller 201 monitors the presence or absence of a request for acceleration in step S5. If it is determined at time t4 that a request for acceleration is made, the engine controller 201 proceeds to step S6 to generate commands for shifting the operating mode from the long duration mode to the optimum duration mode, to the bank A controller 202A and the bank B controller 202B. Thus, shifting of the operating mode from the long duration mode to the optimum duration mode is effected when a request for acceleration is made, so that the driver feels less uncomfortable or is less likely to be disturbed due to shifting of the mode.

Upon receipt of the commands as described above in step S30 and step S58, the bank A controller 202A and the bank B controller 202B proceed to step S31 and step S59, respectively. In step S31 and step S59, the operating mode shifts from the long duration mode to the optimum duration mode, and normal control of VVT for both of the banks A and B resumes.

In response to the shifting of the operating mode to the optimum duration mode, normal control of the throttle opening is resumed in step S7. Namely, while the throttle opening has been reduced to be a little smaller than a value commensurate with the accelerator pedal position until time t4, the throttle opening takes a value commensurate with the accelerator pedal position in the optimum duration mode. Then, the lift and the duration are controlled on the basis of the learned value of the mechanical HIGH end.

During the period between time t4 and time t5, the bank A controller 202A checks if the duration, which has been made variable, is equal to or smaller than a predetermined threshold value. If it is determined at time t5 that the duration is smaller than the threshold value, the bank A controller 202A proceeds to step S33. In step S33, the bank A controller 202A informs the bank B controller 202B of start of learning of the mechanical LOW end (the position of the minimum lift end). The bank A controller 202A then proceeds to step S34. In response to the information received in step S60, the bank B controller 202B proceeds to step S61.

In step S34 and subsequent steps, learning of the mechanical LOW end is carried out. For learning of the mechanical LOW end, the bank A controller 202A initially executes step S34 to operate the actuator to gradually drive the drive shaft 410 toward the mechanical LOW end, and proceeds to step S35 to determine whether the drive shaft 410 abuts on the mechanical LOW end (the position of the mechanical minimum lift end). An affirmative decision (YES) is made in step S35 when the count value generated by the sensor 1000 indicates that the position of the rotor of the actuator shows no further increase. Steps S34 and S35 are repeatedly executed until the drive element (drive shaft 410) driven by the actuator abuts on the mechanical LOW end.

In parallel with the process of steps S34 and S35, the bank B controller 202B initially executes step S61 to operate the actuator to gradually drive the drive shaft 410 toward the mechanical LOW end, and proceeds to step S62 to determine whether the drive shaft 410 reaches the control LOW end (the position of the minimum lift end that is supposed to be reached by the drive shaft 410 under control of the controller 202B). An affirmative decision (YES) is made in step S62 when the count value generated by the sensor 1000 for detecting the position of the rotor of the actuator becomes equal to a predetermined value. Steps S61 and S62 are repeatedly executed until the drive element (drive shaft 410) driven by the actuator reaches the control LOW end.

If the bank B controller 202B determines in step S62 that the drive shaft 410 reaches the control LOW end, the controller 202B proceeds to step S63 to stop operating the actuator for the bank B for the period between time t5 and time t6 as shown in FIG. 8, to thus hold the drive shaft 410 at the position of the control LOW end.

If the bank A controller 202A determines in step S35 during the period between t5 and t6 that the drive shaft 410 for the bank A abuts on the mechanical LOW end, the controller 202A proceeds to step S36 to set the duration sensor value VCA to a value corresponding to the mechanical LOW end. In the waveform diagram of FIG. 8, the actual duration and the duration sensor value VCA are set equal to each other at time t6.

Upon completion of learning of the mechanical LOW end at time t6, the bank A controller 202A informs the engine controller 201 and the bank B controller 202B of completion of the LOW-end learning in step S37. Then, the bank A controller 202A proceeds to step S38 to shift to a normal operating mode in which the engine (the bank A) resumes its normal operation.

In response to the information acquired in step S8, the engine controller 201 proceeds to step S9 to shift to a normal operating mode in which the engine resumes its normal operation. Similarly, the bank B controller 202B proceeds to step S65 in response to the information acquired in step S64, so as to shift to a normal operating mode in which the engine (the bank B) resumes its normal operation.

Upon shifting to the normal mode, the duration sensor value VCA for the bank A is set to the value of the mechanical LOW end, and then the operation of the engine in the optimum duration mode is performed on the basis of this value. The learning process as described above ends in steps S10, S39 and S66.

In this embodiment, learning of the mechanical LOW end is performed after learning of the mechanical HIGH end, and the duration is eventually controlled using the learned value of the mechanical LOW end as a reference value. The control of the duration is performed based on the learned value of the mechanical LOW end because the lift is low on the side of the mechanical LOW end, and the rate of change of the intake air amount is larger on this side with respect to the same movement of the drive shaft 410 driven by the actuator, as compared with that on the side of the mechanical HIGH end, which makes it necessary to control the duration with the higher accuracy on the side of the mechanical LOW end. However, in alternative embodiments the duration may be corrected using both of the learned values after both of the mechanical HIGH end and the mechanical LOW end are learned.

Referring again to FIG. 1 for summarization of this embodiment of the invention, the engine 100 includes the banks A, B, the VVTL mechanisms 126A, 126B provided for the banks A, B, respectively, for changing the operating characteristics of the intake valves, and the control device 200 for controlling the VVTL mechanisms 126A, 126B. The control device 200 controls the VVTL mechanisms 126A, 126B by integrating a plurality of pieces of control information associated with the VVTL mechanism 126A, 126B, respectively. When one of the pieces of control information becomes unknown, for example, when the information is eliminated or cleared, the controller for the VVTL mechanism of the bank involving the unknown control information performs a process of learning control information, and the controller for the VVTL mechanism of the other bank continues to perform control using the corresponding control information.

As shown in FIG. 4 and FIG. 5, each of the VVTL mechanisms 126A, 126B includes the actuator 500 that determines the lift of the intake valves of the corresponding bank by moving the drive shaft 410, and the sensor 1000 that detects changes in the relative position of the drive shaft 410 of the actuator 500. The control information includes the absolute position of the drive shaft 410, which is obtained by adding changes in the relative position to the reference position in accordance with the output of the sensor 1000. If the absolute position calculated for one of the banks A and B (which will be called "first bank") becomes unknown, the control device 200 provisionally sets the absolute position to a first operational limit value (mechanical LOW end) of the drive shaft 410 on the side of the lowest lift, and operates the actuator 500 so as to gradually increase the lift until the drive shaft 410 reaches a second operational limit value (mechanical HIGH end) opposite to the first operational limit, as shown in the period between t1 and t3 in FIG. 6. In this period, the control device 200 learns a first reference position as the absolute position when the drive shaft 410 reaches the second operational limit. With regard to the second bank for which the absolute position is known, the actuator 500 operates the drive shaft 410 within a specified range defined between the first and second operational limits, in accordance with the movement of the drive shaft 410 for the first bank.

Preferably, each of the VVTL mechanisms 126A, 126B further includes a valve timing mechanism for advancing or retarding the timing of the opening and closing of the intake valves, which defines the valve-open period in which the valves are open. During learning of the first reference position, the control device 200 causes the valve timing mechanisms for the first and second banks to hold the valve-open period at a certain middle position (in other words, keep the VVT advance amount equal to a certain middle value, for example, 20FR as shown in FIG. 6).

Preferably, each of the VVTL mechanism 126A, 126B moves the drive shaft 410 to increase the lift (i.e., the maximum lift of the valves) and also increase the duration.

According to the illustrated embodiment of the invention, when the duration becomes unknown, control for learning the position of the mechanical HIGH end is initially performed, so that learning control can be accomplished without causing a reduction in engine output. Also, the VVT mechanism keeps the VVT advance amount equal to a certain middle value (i.e., holds the valve-open period at a certain middle position) during learning, so that learning can be accomplished without causing knocking in engine, or in an excessive EGR region in which an excessive amount of exhaust gas returns to the engine.

Furthermore, the engine shifts to and operates in the long duration operating mode for a time after learning of the mechanical HIGH end. In this operating mode, even if the duration changes, torque shock does not occur due to a rapid change in the engine torque if the duration is kept within a region that is equal to or larger than a certain value.

Furthermore, learning of the mechanical LOW end is immediately performed when the duration is smaller than the predetermined threshold value after the engine shifts to the optimum duration mode after learning of the mechanical HIGH end. Thus, the learning of the LOW end, which requires high learning accuracy, is performed immediately upon meeting of the conditions, thus ensuring control with high accuracy.

In addition to the above-described advantageous effects, when the learned value of the duration of the VVTL mechanism for one bank becomes unknown, the VVTL mechanism for the other bank (normal bank) is operated in substantially the same manner as that for the bank for which relearning is performed, so that the learning operation can be accomplished without causing a difference in the torque between the two banks.

While the engine is provided with the mechanisms for changing the operating characteristics of the intake valves in the illustrated embodiment, the application of the invention is not limited to this type of engine, but may be applied to engines provided with mechanisms (such as VVT or VVTL) for changing the operating characteristics of the exhaust valves in addition to or in place of the mechanism for changing the operating characteristics of the intake valves.

While the invention has been described with reference to an exemplary embodiment thereof, for illustrative purpose only, it is to be understood that the invention is not limited to the exemplary embodiment or construction, but may be otherwise embodied with various changes, modifications, improvements and/or equivalent arrangements, which occur to those skilled in the art without departing from the scope of the invention as defined in the appended claims.

What is claimed is:

1. A control system for an internal combustion engine including a plurality of banks and a plurality of variable valve actuating mechanisms, provided for the respective banks, for changing operating characteristics of intake valves, the control system comprising:

a control device that controls the plurality of variable valve actuating mechanisms, by integrating a plurality of pieces of control information corresponding to the respective variable valve actuating mechanisms;

wherein, when at least one of the plurality of pieces of control information becomes unknown, the control device learns the control information with respect to the variable valve actuating mechanism for the bank involving the unknown control information, and continues to control the variable valve actuating mechanisms for the remaining banks of the plurality of banks, using the known control information of the plurality of pieces of control information, and wherein, each of the variable valve actuating mechanisms includes an actuator that moves a drive element to adjust a lift of each of the intake valves of the corresponding bank, and a sensor that detects a change in a relative position of the drive element of the actuator;

the control information includes an absolute position of the drive element which is calculated by adding the change in the relative position to a reference position in accordance with an output of the sensor; and when the absolute position calculated with respect to a first bank of the plurality of banks becomes unknown, the control device provisionally sets the absolute position to a value of a first operational limit of the drive element which provides the lowest lift of the intake valve, operates the actuator to gradually increase the lift until the drive element reaches a second operational limit which provides the highest lift of the intake valve, and learns a first reference position as the absolute position when the drive element reaches the second operational limit, and the control device causes the actuator to operate the drive element for another bank of the plurality of banks, in which the absolute position is known, so that the drive element moves within a specified range between the first and second operational limits, in accordance with the movement of the drive element for the first bank.

2. The control system according to claim 1, wherein:

each of the variable valve actuating mechanisms further includes a variable valve timing mechanism that advances or retards the opening timing of each of the intake valves; and the control device causes the variable valve timing mechanisms for the first and second banks to hold the opening timing at a specified middle position during an operation for learning the first reference position.

3. The control system according to claim 1, wherein each of the variable valve actuating mechanisms moves the drive element so as to increase the lift and duration of each of the intake valves.

4. A method of controlling an internal combustion engine including a plurality of banks, and a plurality of variable valve actuating mechanisms provided for the respective banks for changing operating characteristics of intake valves, the method comprising:

integrating a plurality of pieces of control information corresponding to the respective variable valve actuating mechanisms;

controlling the variable valve actuating mechanisms in accordance with the integration of the plurality of pieces of control information; and learning the control information with respect to the variable valve actuating mechanism when at least one of the plurality of pieces of control information becomes unknown for one of the plurality of banks, and continuing to control the variable valve actuating mechanisms for the remaining banks of the plurality of banks, using the known control information of the plurality of pieces of control information;

wherein, each of the variable valve actuating mechanisms includes an actuator that moves a drive element to adjust a lift of each of the intake valves of the corresponding bank, and a sensor that detects a change in a relative position of the drive element of the actuator;

the control information includes an absolute position of the drive element which is calculated by adding the change in the relative position to a reference position in accordance with an output of the sensor;

when the absolute position calculated with respect to a first bank of the plurality of banks becomes unknown, the absolute position is provisionally set to a value of a first operational limit of the drive element which provides the lowest lift of the intake valve, and the actuator is operated to gradually increase the lift until the drive element reaches a second operational limit, which provides the highest lift of the intake valve, so that a first reference position is learned as the absolute position when the drive element reaches the second operational limit; and during the learning process for the first bank, the actuator for another bank of the plurality of banks, in which the absolute position is known, is operated to move the drive element within a specified range between the first and second operational limits, in accordance with the movement of the drive element for the first bank.

5. The method according to claim 4, wherein:

each of the variable valve actuating mechanisms further includes a variable valve timing mechanism that advances or retards the opening timing of each of the intake valves; and the variable valve timing mechanisms for the first and second banks hold the opening timing at a specified middle position during an operation for learning the first reference position.

6. The method according to claim 4, wherein each of the variable valve actuating mechanisms moves the drive element so as to increase the lift and duration of each of the intake valves.

* * * * *